US005411111A

United States Patent [19]

Greve

[11] Patent Number: 5,411,111

[45] Date of Patent: May 2, 1995

[54] ROLLING STAIRWAY

[75] Inventor: Christopher Greve, Covington, La.

[73] Assignee: The Laitram Corporation, New Orleans, La.

[21] Appl. No.: 142,800

[22] Filed: Oct. 25, 1993

[51] Int. Cl.[6] ..... E04G 3/00; E06C 5/00

[52] U.S. Cl. ..... 182/17; 182/116

[58] Field of Search ..... 182/17, 15, 116, 115, 182/127, 1

[56] References Cited

U.S. PATENT DOCUMENTS

| | | | |
|---|---|---|---|
| 2,362,170 | 11/1944 | Swaisgood | 182/17 X |
| 2,798,652 | 7/1957 | Easton | 182/15 X |
| 2,923,373 | 2/1960 | Ledgerwood | 182/17 X |
| 3,155,190 | 11/1964 | Borgman | 182/15 |
| 3,664,458 | 5/1972 | Sterns et al. | 182/116 X |
| 4,044,857 | 8/1977 | Guérette | 182/17 |

OTHER PUBLICATIONS

McMaster-Carr Supply Company Catalog, pp. 1174–1175.

*Primary Examiner*—Karen J. Chotkowski

*Attorney, Agent, or Firm*—Pravel, Hewitt, Kimball & Krieger

[57] ABSTRACT

A rolling platform ladder includes a frame supporting a stairway and a flat work platform area at the top of the stairway. The frame includes a base portion that has a cantilevered front area for preventing tipping over if the platform is overloaded. A main structural support column is placed at the center portion of the platform and extends down at an angle toward the rear of the base. At least a portion of the platform is positioned in front of the column during use. This configuration enables at least a portion of the platform to be positioned over machines, conveyors and over obstructions. A portion of the base extends in front of the frame so that it can extend under objects elevated slightly above a work surface such as an elevated conveyor or machine.

9 Claims, 3 Drawing Sheets

ROLLING STAIRWAY

BACKGROUND OF THE INVENTION

1. Field of the Invention

The present invention relates to rolling ladders, and like devices. More particular, the present invention relates to an improved rolling platform stairway having a work platform supported at the upper end of a structural frame and a rolling base supported at the lower end of the frame, with a diagonally extending ladder communicating with the platform and with the base, and wherein an improved configuration of the frame allows the platform to be positioned above machines and other obstructions.

2. General Background

Rolling ladders and rolling stairways are commercially available. These devices typically include a structural frame made of welded or bolted tubular stock such as piping or of structural steel members such as angle shapes, flanged beams, channels and the like. One rolling platform ladder that is commercially available from the McMaster-Carr Supply Company of Atlanta, Ga. uses a rolling base having four casters, and an inclined stairway that has a number of treads or steps such as for example five to ten (5–10) steps.

Rolling platforms are available in a number of differing platform heights such as for example heights of between five and ten feet. Typically, rolling platform ladders include a structural frame that includes one or more vertical columns that are spaced away from the stairway portion and which limit movement of the device when approaching a vertically extending object. The vertically extending columns are positioned at the extreme end portion of the frame opposite the entry level tread. Because these support columns are vertical, they contact any object that is approached, limiting further movement of the apparatus. This prevents placement of the platform over objects such as conveyors, machines, and the like.

In an attempt to provide a rolling platform ladder that can straddle machines and obstructions, a Cantilever V-base ladder has been provided commercially to the industry. Cantilever V-base ladders include a ladder section that extends at an angle from the base and having an open portion under the top section of the ladder so that the ladder can straddle machines and obstructions. Cantilever ladders typically involve only a ladder section and do not provide a work area for the user at the top portion of the ladder.

Some rolling platform ladders provide stock piling shelves underneath the uppermost work platform. The shelves can be adjustable in some models.

SUMMARY OF THE PRESENT INVENTION

The present invention provides an improved rolling platform ladder that includes a frame for supporting a stairway and a flat work platform at the top of the stairway. A base portion of the stairway has a cantilevered front that prevents tipping over if the platform is overloaded.

A main structural support column of the frame is placed at the rear of the platform and extends downwardly therefrom at an angle toward the rear of the base so that at least a portion of the platform is positioned in front of the column during use, for placement over machines and other obstructions. A portion of the base can extend under raised objects such as conveyors and machines.

In the preferred embodiment, the apparatus includes a frame having upper and lower end portions and a stairway that extends between the upper and lower end portions of the frame. The stairway includes a first tread at the lower end portion and a final tread at the upper end portion with a plurality of treads spaced there between.

A platform is supported upon the frame at the upper end portion, the platform providing a flat surface that provides footing and a work area for a user. The platform has a front edge portion and a rear edge portion.

The lower end portion of the frame includes a wheeled base that includes two pairs of casters, one of the pairs of casters being positioned generally under the platform and the other pair of casters being positioned under the entry area at the bottom step or tread of the stairway.

The frame provides structural support for holding the platform and stairway in an elevated position. The frame is recessed in the area below the platform and above the base. The frame is thus configured to provide an open area below at least a portion of the platform and above the base. Many objects (machinery, conveyors) can penetrate the frontal plane and occupy the area under the platform during use. For example, a user can access a lamp that is directly over a conveyor belt in a factory. The frame includes a pair of columns that each extend from the middle of the platform to the base adjacent one of the pair of casters. The columns are connected to the middle of the platform and to the base at a position that is farther away from the platform, as the columns angle toward the first tread of the stairway.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
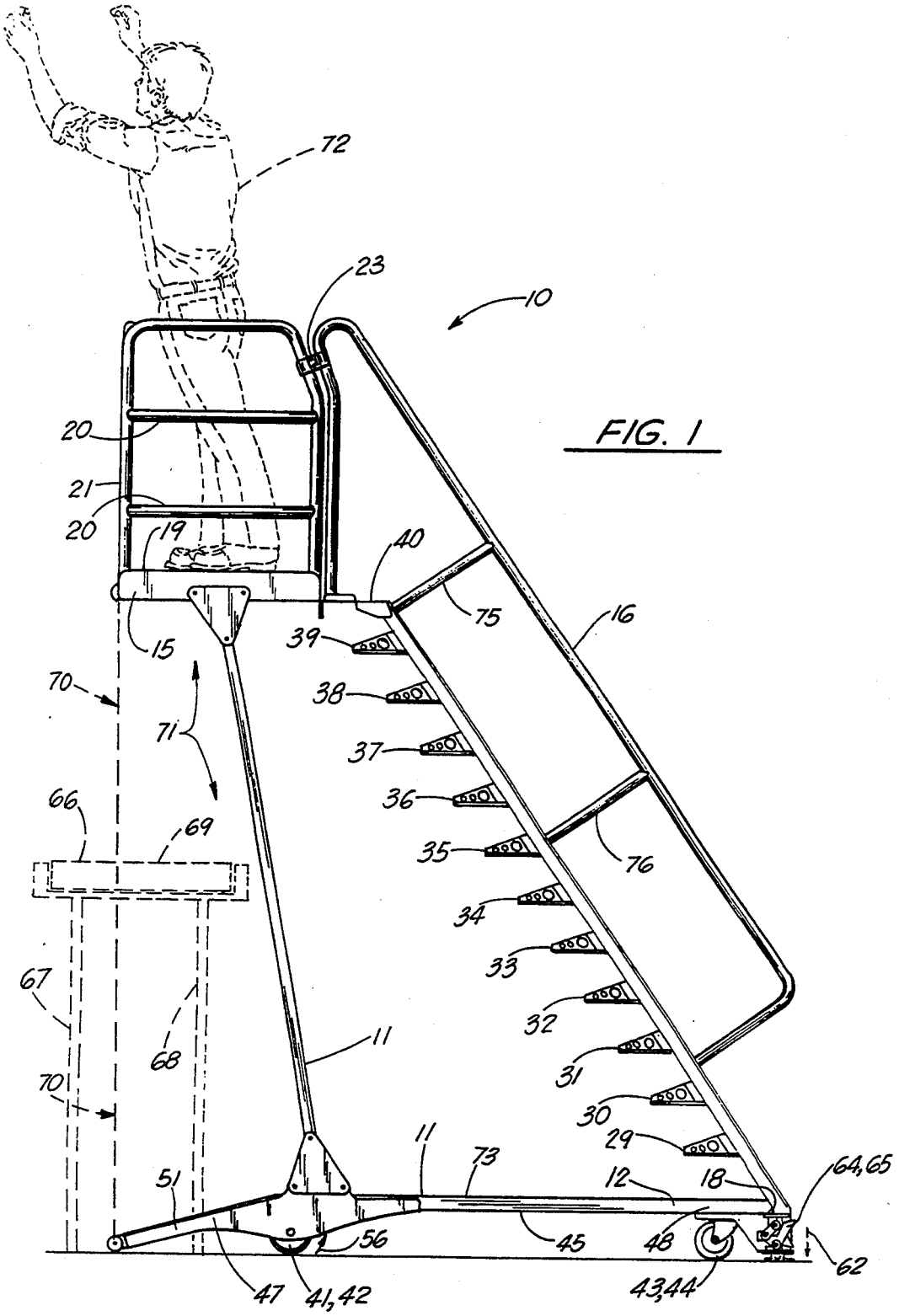
FIG. 1 is a side view of the preferred embodiment of the apparatus of the present invention.
Figure 2:
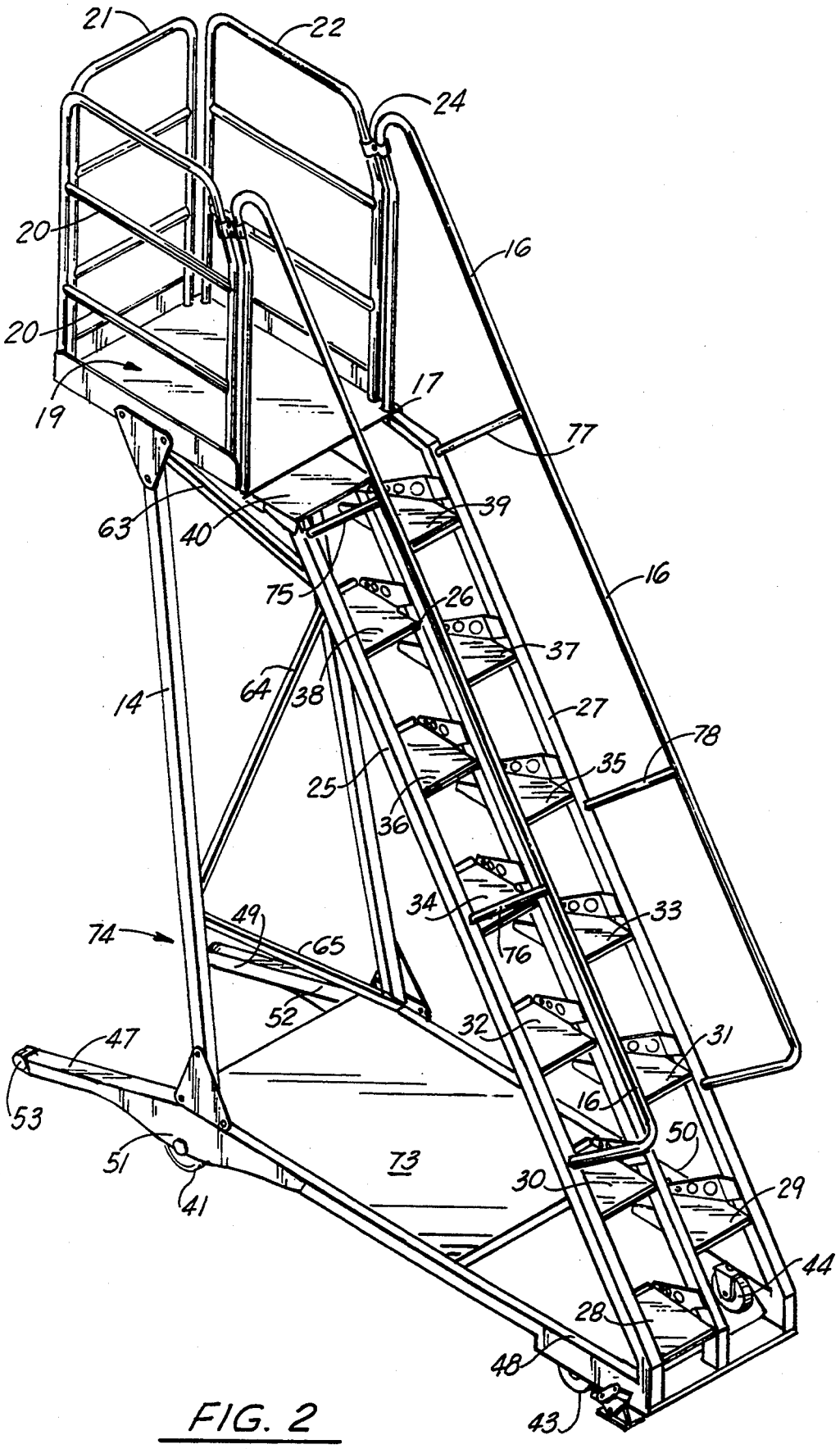
FIG. 2 is a perspective view of the preferred embodiment of the apparatus of the present invention.
Figure 3:
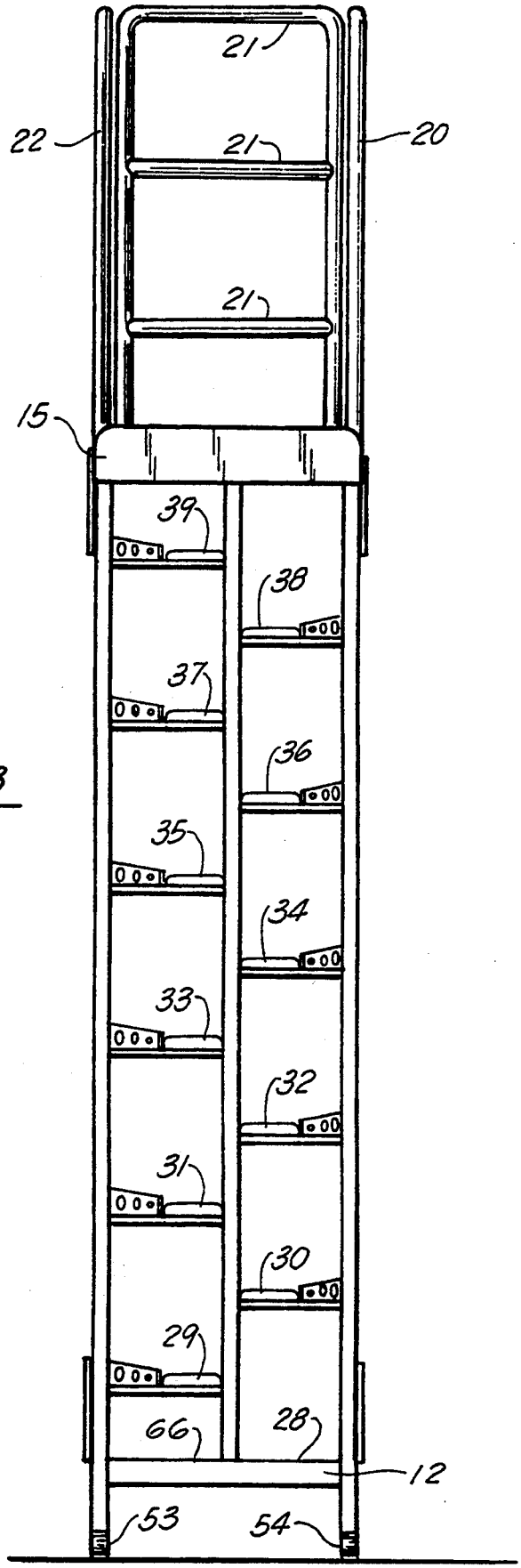
FIG. 3 is a front view of the preferred embodiment of the apparatus of the present invention.

FIGS. 1–3 illustrate the preferred embodiment of the apparatus of the present invention designated generally by the numeral 10. Rolling stairway 10 includes a structural frame 11 that comprises base 12, stairway section 13, inclined columns 14 and platform 15. Handrail 16 can extend between stairway 13 and platform 15 being connected to stairway 13 at connection 17 and to platform 15 at connection 18.

Platform 15 includes a generally rectangular pedestal 19 and three side walls 20–22. Hand rails 16 can be connected to side walls 20, 22 using clamps 23–24. Stairway 13 includes a plurality of stringers 25–27 and a plurality of treads 28–40. The tread 28 is a first or entry tread and the tread 40 is the final tread which communicates with surface 19. The hand rails 16 are supported along their lengths by rail supports 75–78 extending outwardly from the outer stringers 25, 27.

Base 12 is supported upon a plurality of casters 41–44. The casters 41–42 are preferably not steerable. The casters 43, 44 are swiveling casters and thus steerable. During use, a user will typically hold the handrail 16 and push the stairway 10, steering same with the casters 43, 44.

Base 12 includes a pair of longitudinally extending beams 45, 46, each having end portions. The beam 45 includes a first end portion 47 and a second end portion 48. The beam 46 includes a first end portion 49 and a second end portion 50. Each beam 45, 46 includes an inclined portion 51, 52 respectively as shown in FIG. 1.

The inclined sections 51, 52 define a cantilever that carries small casters 53, 54 respectively. The small caster wheels are positioned to hang from inclined portions 51, 52 slightly above an underlying flat surface 55. They are designed to engage the surface 55 if the surface 55 is uneven for example. Further, if the platform 15 is overloaded, the stairway 10 will rotate about casters 41, 42 as shown by arrow 56 in FIG. 1. However, after a short rotation, the wheels 53, 54 will engage the underlying surface 55 and prevent any further rotation of the entire apparatus 10. A pair of brakes 58, 59 are provided on base 12 adjacent tread 28. Brakes 58, 59 are commercially available from Bassic Caster Company. Each brake 58, 59 has a brake shoe 60, 61 respectively that engages the underlying floor surface when a foot pedal is depressed. To release a brake 58, 59, a foot pedal 64, 65 is depressed. Arrow 62 designates movement of a brake shoe 60, 61 to the lower, floor engaging position.

A plurality of a diagonally extending stiffeners 63-65 are shown in FIG. 2 extending between the spaced-apart inclined columns 14. Stiffeners 63–65 provide additional strength for larger model rolling stairways 10. Stiffeners 63–65 might not be required, for example, in smaller rolling stairways 10 wherein, for example, the number of treads 28–40 was relatively small such as, for example, 3 or 4 treads as opposed to 10 or 15 treads.

In FIG. 1, the preferred embodiment of the apparatus of the present invention 10 is shown illustrated in use adjacent a conveyor system 66. Conveyor 66 is schematically shown in the FIG. 1 in phantom lines for purposes of illustrating use of the apparatus 10 of the present invention. It should be understood however that the present invention can be used to avoid other types of machinery such as machine frames, shop equipment, furniture that cannot be easily moved, tool cabinets, and the like.

The conveyor system 66 shown in FIG. 1 includes a pair of spaced-apart vertical posts 67, 68 as well as a plurality of vertical posts that are spaced at intervals along the length of conveyor system 66. Thus, the platform 15 is to be positioned above the conveyor system 66. Also, the inclined sections 51, 52 can straddle a particular post 68. The conveyor system 66 includes an upper conveyor section 69. In FIG. 1, the front of rolling stairway 10 is defined by the front surface of side wall 21 and by the small casters 53, 54 and designated as a plane 70 in the drawings. The area between plane 70 and inclined columns 14 represents an open area 71 that can be occupied by equipment such as conveyor systems 66 during use.

In the prior art, the plane 70 is typically occupied with a vertical column or columns or by a truss that is vertically oriented, extending between a base portion and the platform portion of a rolling stairway. By providing the open area 71, a user 72 can access overhead equipment such as storage shelves, lighting, electrical or other utilities, overhead piping, or the like to perform regular maintenance or to retrieve equipment. A tool tray 73 can be provided on base 12, extending between beams 45, 46 in a transverse direction, and extending from casters 41, 42 rearwardly toward casters 43, 44. An open area 74 is provided between inclined sections 51, 52 and in front of tool tray 73. Open area 74 allows inclined sections 51, 52 to straddle obstructions such as vertical support post 67.

Thus, the configuration of FIG. 1 provides an improved rolling stairway apparatus 10 that solves a problem relating to the accessing of overhead structures that are positioned vertically above equipment, such as conveyor 66 mounted upon a shop floor.

The following table lists the part numbers and part descriptions as used herein and in the drawings attached hereto.

PARTS LIST

| Part Number | Description |
|---|---|
| 10 | rolling stairway |
| 11 | frame |
| 12 | base |
| 13 | stairway section |
| 14 | inclined column |
| 15 | platform |
| 16 | handrail |
| 17 | connection |
| 18 | connection |
| 19 | pedestal |
| 20 | side wall |
| 21 | side wall |
| 22 | side wall |
| 23 | clamp |
| 24 | clamp |
| 25 | stringer |
| 26 | stringer |
| 27 | stringer |
| 28 | tread |
| 29 | tread |
| 30 | tread |
| 31 | tread |
| 32 | tread |
| 33 | tread |
| 34 | tread |
| 35 | tread |
| 36 | tread |
| 37 | tread |
| 38 | tread |
| 39 | tread |
| 40 | tread |
| 41 | caster |
| 42 | caster |
| 43 | caster |
| 44 | caster |
| 45 | beam |
| 46 | beam |
| 47 | end portion |
| 48 | end portion |
| 49 | end portion |
| 50 | end portion |
| 51 | inclined section |
| 52 | inclined section |
| 53 | small caster |
| 54 | small caster |
| 55 | flat surface |
| 56 | arrow |
| 57 | work surface |
| 58 | brake |
| 59 | brake |
| 60 | brake shoe |
| 61 | brake shoe |
| 62 | arrow |
| 63 | diagonal stiffener |
| 64 | diagonal stiffener |
| 65 | diagonal stiffener |
| 66 | conveyor |

-continued

| PARTS LIST | |
|---|---|
| Part Number | Description |
| 67 | vertical support post |
| 68 | vertical support post |
| 69 | belt |
| 70 | plane |
| 71 | open area |
| 72 | user |
| 73 | tool tray |
| 74 | open area |
| 75 | rail support |
| 76 | rail support |
| 77 | rail support |
| 78 | rail support |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A rolling stairway apparatus comprising:

a) a frame having upper and lower end portions and a stairway extending between the upper and lower end portions, the stairway having a first tread at said lower end portion defining an entry to the stairway and a final tread at the upper end portion and a plurality of treads between the first and the final tread;

b) a platform supported upon the frame at the upper end portion and above the final tread that includes a flat surface that provides footing and a work area for a user that is substantially larger in area than the treads, the platform having a front edge portion and a rear edge portion, the front edge portion defining a frontal plane of the apparatus that limits placement of the platform against a vertical surface that extends as high as the platform;

c) the lower end portion of the frame including a wheeled base that includes a plurality casters that includes at least a first pair of casters positioned generally under the front edge portion of the platform and a second pair of the casters being positioned under the entry;

d) the frame providing structural support for holding the platform and stairway in elevated position and being configured to provide an open area below at least a portion of the platform and above the base so that objects can penetrate the frontal plane and occupy the area under the platform during use; and e) the base including a pair of spaced apart outrigger portions extending in front of the frame with a space therebetween, said outrigger portions having respective free ends that are positioned at the frontal plane, said first pair of casters being outrigger wheels positioned at the free ends of the outrigger portions respectively.

2. The rolling stairway apparatus of claim 1 wherein the frame includes a plurality of diagonally extending stairway stringers.

3. The rolling stairway apparatus of claim 1 wherein the outrigger portion carries a pair of outrigger wheels that are smaller than the casters.

4. A rolling stairway apparatus comprising:

a) a frame having upper and lower end portions and a stairway extending between the upper and lower end portions, the stairway having a first tread at said lower end portion defining an entry to the stairway and a final tread at the upper end portion and a plurality of treads between the first and the final tread;

b) a platform supported upon the frame at the upper end portion that includes a flat surface that provides footing and a work area for a user, the platform having a front edge portion and a rear end portion, the front edge portion defining a frontal plane of the apparatus that limits placement of the platform against a vertical surface that extends as high as the platform;

c) the lower end portion of the frame including a wheeled base that includes two pairs of casters, a first pair of the pairs of casters positioned generally under the platform and a second pair of the casters being positioned under the entry;

d) the frame providing structural support for holding the platform and stairway in elevated position and being configured to provide an open area below at least a portion of the platform and above the base so that objects can penetrate the frontal plane and occupy the area under the platform during use;

e) wherein the frame includes a pair of columns that connect to the base at the first pair of casters, each column being connected to a middle of the platform.

5. The rolling stairway of claim 4 wherein the frame comprises:

a) a base having a pair of longitudinally extending, generally parallel beams;

b) a plurality of diagonally extending stairway stringers extending from the base and forming an acute angle with the base;

c) a platform having front and rear edge portions, the rear edge portion being affixed to the top end of the stringers; and d) a column attaching to the platform at a position between the front and rear edge portions, the column attaching to the base at a position that is generally vertically aligned with the rear edge portion of the platform.

6. The rolling stairway apparatus of claim 5 wherein the base is at least twice as long between the stringers and the column as the length of the platform between the column and the stringers.

7. A rolling stairway apparatus comprising:

a) a frame having upper and lower end portions and a stairway extending between the upper and lower end portions, the stairway having a first tread at said lower end portion defining an entry to the stairway and a final tread at the upper end portion and a plurality of treads between the first and the final tread;

b) a platform supported upon the frame at the upper end portion that includes a flat surface that provides footing and a work area for a user, the platform having a front edge portion and a rear edge portion, the front edge portion defining a frontal plane of the apparatus that limits placement of the platform against a vertical surface that extends as high as the platform;

c) the lower end portion of the frame including a wheeled base that includes two pairs of casters, one of the pairs of casters positioned generally under the platform and the other pair of the casters being positioned under the entry;

d) the frame including a column that extends from the middle of the platform to the base adjacent one of the pair of casters, and forming an acute angle with the frontal plane;

e) the frame providing structural support for holding the platform and stairway in elevated position and being configured to provide an open area below at least a portion of the platform and above the base and in front of the column.

8. A rolling stairway apparatus comprising:

a) a frame having upper and lower end portions and a stairway extending between the upper and lower end portions, the stairway having a first tread at said lower end portion defining an entry to the stairway and a final tread at the upper end portion and a plurality of treads between the first and the final tread;

b) a platform supported upon the frame at the upper end portion that includes a flat surface that provides footing and a work area for a user, the platform having a front edge portion and a rear edge portion, the front edge portion defining a frontal plane of the apparatus that limits placement of the platform against a vertical surface that extends as high as the platform;

c) the lower end portion of the frame including a wheeled base that includes two pairs of casters, a first pair of the pairs of casters positioned generally under the platform and a second pair of the casters being positioned under the entry;

d) the frame providing structural support for holding the platform and stairway in elevated position and being configured to provide an open area below at least a portion of the platform and above the base so that objects can penetrate the frontal plane and occupy the area under the platform during use, e) wherein the base includes an outrigger portion that extends in front of the first pair of casters;

f) wherein outrigger portion has outrigger wheels and the casters are of a first, uniform diameter, and the outrigger wheels are of a second, smaller diameter.

9. A rolling stairway apparatus comprising:

a) a frame having upper and lower end portions and a stairway extending between the upper and lower end portions, the stairway having a first tread at said lower end portion defining an entry to the stairway and a final tread at the upper end portion and a plurality of treads between the first and the final tread;

b) a platform supported upon the frame at the upper end portion and above the final tread that includes a flat surface that provides footing and a work area for a user that is substantially larger in area than the treads, the platform having a front edge portion and a rear edge portion, the front edge portion defining a frontal plane of the apparatus that limits placement of the platform against a vertical surface that extends as high as the platform;

c) the lower end portion of the frame including a wheeled base that includes plurality of casters;

d) the frame providing structural support for holding the platform and stairway in elevated position and being configured to provide an open area below at least a portion of the platform and above the base so that objects can penetrate the frontal plane and occupy the area under the platform during use;

e) wherein the base includes a pair of outrigger portions that each extend in front of the frame, the outrigger portions having a space therebetween so that vertically extending objects can fit within said space when a user is working on the platform positioned above said space; and f) the outrigger portions each having free end portions for engaging the underlying ground to prevent tipping of the apparatus, said free end portions being positioned adjacent said frontal plane, under the front edge portion of the platform.

* * * * *